United States Patent [19]

Weiss et al.

[11] Patent Number: 4,953,215

[45] Date of Patent: Aug. 28, 1990

[54] ARRANGEMENT TO PREVENT THE INTRUSION OF FOREIGN MATTER INTO AN ELECTRO-ACOUSTICAL TRANSDUCER

[75] Inventors: Hans-Joachim Weiss, New Providence, N.J.; Christof Haertl, Neunkirchen; Juergen Wagner, Kueps, both of Fed. Rep. of Germany

[73] Assignee: Siemens Aktiengesellschaft, Berlin and Munich, Fed. Rep. of Germany

[21] Appl. No.: 417,389

[22] Filed: Oct. 5, 1989

[51] Int. Cl.[5] ..... H04R 25/02

[52] U.S. Cl. ..... 381/68; 381/68.6; 181/130; 181/135

[58] Field of Search ..... 381/68, 68.6, 69, 69.1, 381/69.2, 187; 181/130, 135

[56] References Cited

U.S. PATENT DOCUMENTS

| | | | |
|---|---|---|---|
| 3,842,829 | 10/1974 | Ellis | 128/152 |
| 3,852,540 | 12/1974 | Diethelm | 381/68.6 |
| 4,879,750 | 11/1989 | Nassler . | |

FOREIGN PATENT DOCUMENTS

| | | |
|---|---|---|
| 1951165 | 4/1966 | Fed. Rep. of Germany . |
| 1263849 | 3/1968 | Fed. Rep. of Germany . |
| 2258118 | 7/1973 | Fed. Rep. of Germany . |
| 3504891 | 9/1985 | Fed. Rep. of Germany . |
| 8436783 | 5/1986 | Fed. Rep. of Germany . |
| 8504765 | 7/1986 | Fed. Rep. of Germany . |
| 2155276 | 9/1985 | United Kingdom . |

OTHER PUBLICATIONS

Brochure "Gore-Tex (TM) PTFE-Membranen und Laminate", 1986 of W. L. Gore & Co., GmbH, Werner-v.-Braun-Str. 18, D-8011 Putzbrunn, FRG.

*Primary Examiner*—Jin F. Ng
*Assistant Examiner*—M. Nelson McGeary III
*Attorney, Agent, or Firm*—Mark H. Jay

[57] ABSTRACT

In an arrangement to prevent the intrusion of foreign matter into a transducer which extends with a projection provided with an opening into a sound channel of a hearing aid, a reduced need for space as well as simpler construction, compared with the state of the art, are achieved by means of the following characterizing features: A membrane made of pore-free material is provided, which has at least one bore for the passage of sound of from a few hundredths to a few tenths of a millimeter diameter, and in which the wall thickness of the membrane is small with respect to the diameter of the bore.

14 Claims, 2 Drawing Sheets

ARRANGEMENT TO PREVENT THE INTRUSION OF FOREIGN MATTER INTO AN ELECTRO-ACOUSTICAL TRANSDUCER

BACKGROUND OF THE INVENTION

1. Field of the Invention

The invention concerns an arrangement to prevent the intrusion of foreign matter, in particular cerumen, into an electro-acoustical transducer.

2. Technical Backoround

From DE-AS 12 63 849, an arrangement is known for an in-the-ear hearing aid to prevent the intrusion of cerumen (ear wax) into a transducer, which is designed as a hollow member in cap form (ear insert) of elastic material that can be attached to the sound exit nozzle (projection) of a hearing aid, that in its interior presents a chamber-like expansion of a bore for the passage of the sound at its hemispherically-shaped end, in which a layer of porous, sound-permeable material is arranged. Given pore sizes of about 0.2 to 0.5 mm and partitions that are thin by comparison, in order to achieve a great density of pores per surface unit, the porous layer is of relatively great thickness approximately corresponding to the inside cylindrical radius of the hollow member. The wall thickness of the hollow member amounts to about one seventh of the outside cylindrical diameter. It is thus relatively thick. Altogether, this arrangement results in much space being required, especially in the direction of travel of the sound. Besides, two separate components are required to close the sound exit nozzle against the infiltration of cerumen, wherein the hollow member acts as a mounting support (added arrangement) for the porous layer, which in turn prevents the intrusion of cerumen and must be replaced regularly since a cleaning of this porous and hence soft material is not possible.

From DE-GM 84 36 783 and 85 04 765, sieve-like perforated caps are known that can be screwed or snapped into or onto projections that extend from the hearing aid housing as an extension of the sound channel only for this purpose.

The penetration of cerumen into the sound channel is largely prevented by the introduction of recesses (grooves) on the housing outside the sound channel. The outer projection needed only for the mounting of the perforated caps is an added arrangement and necessitates a relatively great length in construction in the direction of the sound propagation, even more and markedly increased by the thickness of the perforated caps projecting from the extensions, especially since the thickness of their walls is on the order of the sieve-like openings. Beyond this, the large number of openings arranged in a sieve-like manner increases the danger of penetration by cerumen.

The object of the present invention is to design an arrangement of the type initially indicated, in such a manner that it will occupy less space and be of simpler construction compared with the state of the art.

SUMMARY OF THE INVENTION

This object is achieved by a hearing aid comprising a housing containing a sound-conducting channel, an electro-acoustic transducer having a projection which extends into said channel, and a nonporous membrane substantially covering said projection. This membrane has at least one bore communicating with said channel, and said bore has a diameter which is at least a few hundredths of a millimeter and is at most a few tenths of a millimeter, and a thickness which is small with respect to said diameter.

An added arrangement — i.e., a separate, cap-shaped hollow member as mount for an inner porous layer (membrane) or an added piece that projects as an extension of the sound channel from the hearing aid housing — becomes superfluous, since the arrangement in accordance with the invention shares in the use of a projection on a transducer (e.g., earphone) that is necessary for other purposes, anyway, by using it as a mounting support for a membrane. Reduced need for space results, especially in the direction of sound propagation (short structural length), from the arrangement of the membrane in accordance with the invention in the sound channel that is necessary anyway. The arrangement on a projection of a hearing aid component extending into the sound channel was made possible by using a non-porous material (greater strength) — metallic materials are especially suitable for this purpose — with extremely thin (foil-like) walls. Measurements in the course of the invention showed, surprisingly, that given a negligible, foil-like thickness of the membrane in accordance with the invention, a bore (produced with a laser beam, for instance) having diameter on the order of the pores in the known thick membranes, preferably up to about 0.6 mm, already suffices to ensure largely undisturbed passage of sound (negligible linear attenuation) through the membrane.

If the diameter of the bore in the thin, foil-like membrane in accordance with the invention is reduced to a few tenths of a millimeter, preferably to around 0.15 mm, surprisingly a clearly non-linear effect on the acoustics occurs, with the result that with linearly increasing output level of the sound source, an increasing attenuation, non-linear, by contrast, occurs in the sound transmissivity of the membrane in accordance with the invention.

Measurements and trials in connection with the invention have shown that with this additional, novel effect of the arrangement in accordance with the invention, it is possible to largely replicate the effect of an electric output-level-limiting circuit (peak-clipping or PC) and/or an automatic gain control (AGC). The arrangement in accordance with the invention therefore also achieves the substantial advantage that an electrical arrangement for non-linear sound level attenuation, hitherto necessary, becomes superfluous, simultaneously reducing the need for space in the hearing aid.

BRIEF DESCRIPTION OF THE DRAWING

Additional features of the invention and additional objects of the invention will be more readily appreciated and better understood by reference to the following detailed description which should be considered in conjunction with the drawing.

DETAILED DESCRIPTION OF THE PREFERRED EMBODIMENT

Figure 1:
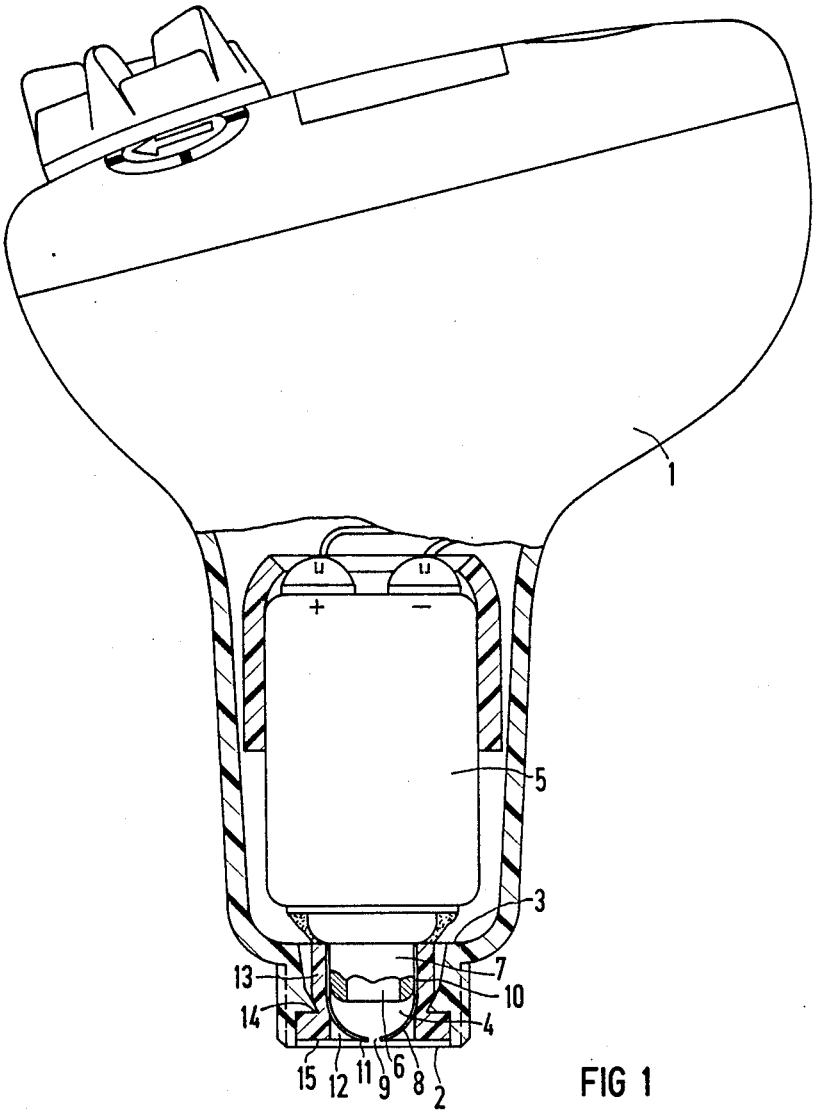
FIG. 1 depicts an in-the-ear hearing aid, illustrating in partial section the housing with an arrangement in accordance with the invention.

The in-the-ear hearIng aid according to FIG. 1 shows a housing 1, in which parts essential to the invention are illustrated, inter alia. Between an outer surfaCe 2 and an inner surface 3 of the housing 1, there extends a sound channel 4, projecting into the sound channel 4 is an earphone 5 with a proJection 7 provided with an opening to the projection 7 a membrane 8 made of a pOrefree, metallic material has been arranged, which has a bore 9 for the passage of sound. The diameter of the bore 9 is only a few tenths of a millimeter. A decisive factor is that the wall thickness of the membrane 8 must be much less than the diameter of the bore 9 of about 1:10 results in a good sound transmission effect given a wall thickness of about 2/100 millimeter.

The membrane 8 is designed in the form of a cap, and made of a deep-drawable material: e.g., mu-metal, as a deep drawn . This will produce good mechanical stability, the negligible wall thickness notwithstanding, especially during mechanical cleaning (scraping off) of cerumen with, for instance, a wire loop. The membrane 8 has a cylindrical area and a convex area 11 pointing away from the former. The convex area 11 increases the mechanical stability of the membrane 8 and the cylindrical area 10 enables a simple clamping attachment to the customarily cylindrical projection 7 of the transducer, here shown as an earphone 5. The projection 7 has a diameter of about 1.4 mm and a length of about 1 mm. The membrane 8 is arranged completely within the sound channel 4, whereby, in conjunction with the convex area 11, a ring-shaped depression 12 results within the sound channel 4. Cerumen can collect in this ring-shaped depression 12, making a special groove to be molded into the housing 1 for the collection of cerumen superfluous.

The projection 7 on the earphone 5, together with the membrane 8 clamp-fastened thereto, is held in a sleeve 13 of sound-damping material, e.g., a silicon tube, in the housing 1 by means of a snap or catch connection 14 and is at the same time designed as the sound channel. The inside diameter of the sound channel 4 corresponds more or less to the diameter of the projection 7. Given a negligible elasticity of the sound channel 4, the inner diameter of the sound channel 4 can be made greater by up to double the wall thickness of the membrane 8. A recessed arrangement of the sleeve 13 (the length of construction is made shorter than the distance between the outer surface 2 and the inner surface 3 of the housing 1), results in a further ring-shaped depression 15 in the outer surface 2 of the housing, in which cerumen can also collect. The result is a very long path for the cerumen, before it can reach the bore 9 arranged in the center of the convex area 11 of the membrane 8. This results in great time intervals between cleanings of the apparatus by a mechanical and therefore inexpensive and simple method.

Because of the negligible wall thickness of the membrane 8, it is also possible to arrange the same (not illustrated herein) within the opening 6 of the projection 7 of the transducer here shown as an earphone 5, whereby the penetration of foreign matter, especially cerumen, into the respective transducer is also prevented.

Since an electrical non-linear sound level control can also be largely replicated by means of the invention, the arrangement is also especially suited for use in conjunction with a transducer designed as a microphone, though not illustrated herein. This would, on the one hand, keep foreign particles away from the microphone that are larger than the diameter of the opening 6 in the membrane 8, while also making other, added arrangements, such as electric level-limiting circuits (PC, AGC) superfluous, and an overload of the electrical hearing aid amplifier and its resulting side effects can be avoided from the start.

Figure 2:
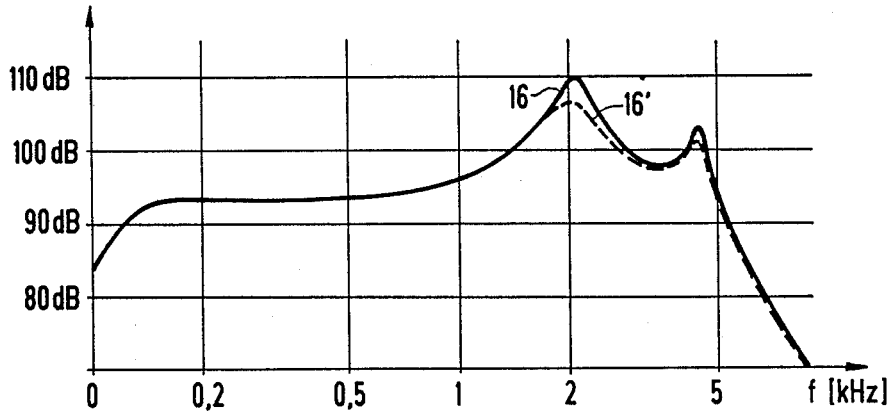
FIGS. 2 through 4 illustrate the attenuation processes in sound levels with various parameters.
Figure 3:
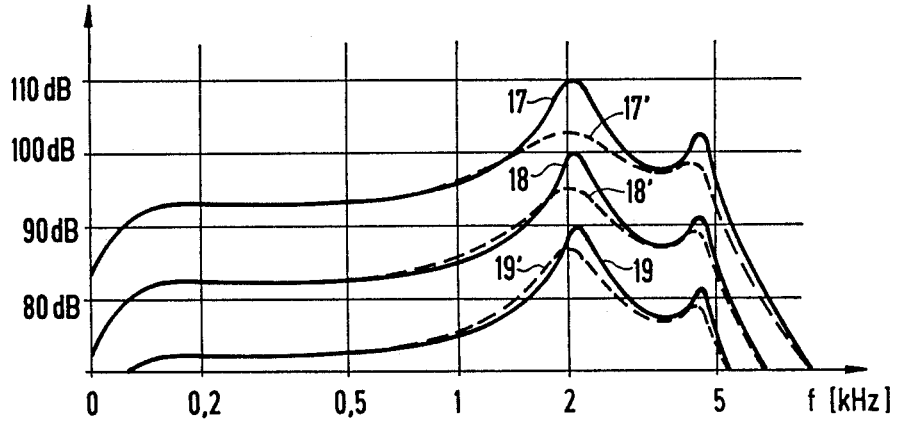
Figure 4:
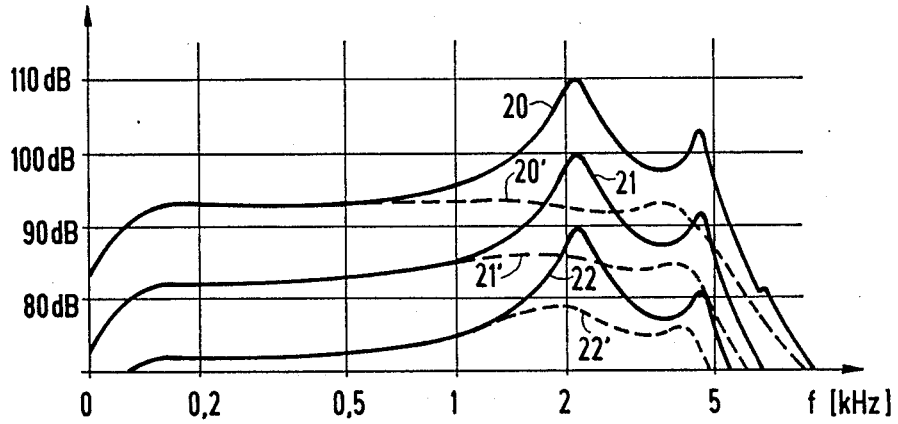

The attainable degree of non-linear influence on the acoustics by the arrangement according to the invention, depending on the level of the sound source and the diameter of the sound exit opening in a membrane according to the invention, is shown by examples in FIGS. 2 to 4, with the aid of curves 16 to 22 and 16′ to 22′, respectively. To simplify the interpretation of the measurement results, the wall thickness of the membrane, with the indicated curves 16′ and 22′, was uniformly established at 0.02 mm and a membrane always made of deep-drawn mu-metal used in every case. All curves were measured on a hearing aid in which an earphone was operated by constant current.

The following parameters apply to FIG. 2:

Diameter of the bore in the membrane: 0.4 mm

Wall thickness of the membrane: 0.02 mm

Maximum output level at the earphone: 110 dB, given curve 16 without, and curve 16′ with, membrane.

FIG. 2 shows clearly that given a diameter Of the bore of 0.4 mm and a maximum output level of 110 dB according to curve 16, an attenuation of ca. dB occurs only at this high output level vis-a-vis the curve 16′. At the lower output levels outside the frequency range of 2 kMz the attenuation difference is clearly less or even non-existent.

The following parameters apply to FIG. 3:

Diameter of the bore in the membrane: 0.25 mm

Wall Thickness of the membrane: 0.02 mm

Maximum output level at the earphone: 110 dB, given curve 17 without, and curve 17′ with, membrane Maximum output level at the earphone: 100 dB, given curve 18 without, and curve 18′ with, membrane Maximum output level at the earphone: 90 dB, given curve 19 without, and curve 19′ with, membrane.

FIG. 3 records the broken-line curves 17′ to 19′, given a diameter of 0.25 for the bore in the membrane. Between the two curves 17 and 17′, there now results a maximum difference in level of ca. 7 dB, again given a maximum output level of 110 dB. Given a maximum output level of 100 dB, the resulting maximum difference between the curves 18 and 18′ is only about 4 dB. Given a maximum output level of 90 dB, the difference between curve 19 and 19′ is only 3 dB. From this it can be seen clearly that the attenuation through the arrangement in accordance with the invention increases nonlinearly with an increasing output level. Beside this, the attenuation increases with the decreasing diameter of the bore, as is made clear from a comparison of curves 16 and 16′ in FIG. 2 with curves 17 and 17′ in FIG. 3.

The following parameters apply to FIG. 4:

Diameter of the bore in the membrane: 0.15 mm

Wall thickness of the membrane: 0.02 mm

Maximum output level at the earphone: 110 dB, given curve 20 without, and curve 20′ with, membrane Maximum output level at the earphone: 100 dB, given curve 21 without, and curve 21′ with, membrane Maximum output level at the earphone: 90 dB, given Curve 22 without, and curve 22′ with, membrane.

In FIG. 4, the described relationships become even clearer, as the diameter of the bore in the membrane has been reduced to 0.15 mm. Vis-a-vis the curve 20 with a maximum sound output level of 110 dB, an attenuation of about 17 dB results with curve 20′, recorded with membrane in accordance with the invention. In addition, this reduction of diameter in the membrane also achieved a nearly rectilinear frequency response curve in the transmission range of the earphone. With reduced output level, the attenuation decreases again non-linearly, as may be seen from the curves 21 and 21', which show a maximum difference in level of 14 dB, and the curves 22 and 22', which show a maximum difference in level of only some 11 dB, given a maximum output level of 90 dB.

There has thus been shown and described a novel hearing aid which fulfills all the objects and advantages sought therefore. Many changes, modifications, variations and other uses and applications of the subject invention will, however, become apparent to those skilled in the art after considering the specification and the accompanying drawing. All such changes, modifications, variations and other uses and applications which do not depart from the spirit and scope of the invention are deemed to be covered by the invention which is limited only by the claims which follow.

We claim:

1. A hearing aid comprising:

a housing containing a sound-conducting channel;

an electro-acoustic transducer having a projection which extends into said channel; and a nonporous membrane substantially covering said projection and having at least one bore communicating with said channel, said bore having a diameter which at least about nine hundredths of a millimeter and is at most about six tenths of a millimeter, and a thickness which is much less than said diameter.

2. A hearing aid according to claim 1, wherein said membrane is cap-shaped.

3. A hearing aid according to claim 1, wherein said membrane is made of metal.

4. A hearing aid according to claim 3, wherein said membrane is made of deep-drawable material.

5. A hearing aid according to claim 3, wherein said membrane is made of mu-metal.

6. A hearing aid according to claim 1, wherein said membrane is located inside said channel and has a diameter which is approximately equal to the outer diameter of said projection.

7. A hearing aid according to claim 6, wherein said membrane has a diameter which exceeds the outer diameter of said projection by up to twice the thickness of said membrane.

8. A hearing aid according to claim 1, wherein the thickness of said membrane is about a few hundredths of a millimeter.

9. A hearing aid according to claim 8, wherein the thickness of said membrane is approximately 0.02 mm.

10. A hearing aid according to claim 1, wherein said membrane has a cylindrical surface and a convex surface extending from an end of said cylindrical surface.

11. A hearing aid according to claim 1, further comprising a clamp which secures the membrane to said projection.

12. A hearing aid according to claim 10, wherein said membrane has said bore arranged at the center of said convex surface.

13. A hearing aid according to claim 1, wherein said electroacoustical transducer is an earphone.

14. A hearing aid comprising:

a tube which forms a sound-conducting channel;

an electro-acoustic transducer having a projection which extends into said tube; and a nonporous membrane substantially covering said projection and having at least one bore communicating with said channel, said bore having a diameter which is at least about nine hundredths of a millimeter and is at most about six tenths of a millimeter, and a thickness which is much less than said diameter.

* * * * *